US007782257B2

(12) United States Patent
Kim et al.

(10) Patent No.: US 7,782,257 B2
(45) Date of Patent: Aug. 24, 2010

(54) MULTI-BAND INTERNAL ANTENNA OF SYMMETRY STRUCTURE HAVING STUB

(75) Inventors: Byung-Chan Kim, Daejeon (KR); Jae-Ick Choi, Daejeon (KR); Byung-Je Lee, Seoul (KR); Byung-Woon Jung, Seoul (KR); Han-Phil Rhyu, Seoul (KR); Byung-Gil Yu, Seoul (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 536 days.

(21) Appl. No.: 11/718,087

(22) PCT Filed: Jul. 4, 2005

(86) PCT No.: PCT/KR2005/002116

§ 371 (c)(1),
(2), (4) Date: Apr. 26, 2007

(87) PCT Pub. No.: WO2006/049382

PCT Pub. Date: May 11, 2006

(65) Prior Publication Data

US 2009/0135077 A1 May 28, 2009

(30) Foreign Application Priority Data

Nov. 5, 2004 (KR) ..... 10-2004-0089854

(51) Int. Cl.
*H01Q 1/38* (2006.01)

(52) U.S. Cl. ..... 343/700 MS; 343/843; 343/870; 343/831

(58) Field of Classification Search ..... 343/700 MS, 343/831, 870, 843
See application file for complete search history.

(56) References Cited

U.S. PATENT DOCUMENTS

| | | | | |
|---|---|---|---|---|
| 6,407,710 | B2 | 6/2002 | Keilen et al. | |
| 6,542,123 | B1 * | 4/2003 | Chen | 343/700 MS |
| 6,683,571 | B2 | 1/2004 | Ghosh et al. | |
| 6,806,834 | B2 | 10/2004 | Yoon | |
| 2003/0112185 | A1 * | 6/2003 | Fang et al. | 343/700 MS |
| 2004/0095281 | A1 | 5/2004 | Poilasne et al. | |
| 2004/0178958 | A1 | 9/2004 | Kadambi et al. | |

FOREIGN PATENT DOCUMENTS

| | | | |
|---|---|---|---|
| KR | 1020030064219 | A | 7/2003 |
| KR | 1020030084243 | A | 11/2003 |
| KR | 1020040054107 | A | 6/2004 |
| WO | WO 9638352 | | 12/1996 |

* cited by examiner

*Primary Examiner*—Douglas W Owens
*Assistant Examiner*—Dieu Hien T Duong

(57) ABSTRACT

A multi-band internal antenna includes a top patch defining a first loop that defines a space therein and a first opening; a stub provided within the space defined by the first loop; a bottom patch provided below the top patch and having a first section and a second section connected to a feeder part and a shorting part, respectively, the bottom patch defining a second loop and second and third openings, the second and third openings being provided on opposing sides of the second loop so that the first and second sections of the bottom patch are separated from each other; and a first connecting part and a second connecting part connecting a first portion and a second portion of the top patch, respectively, to the first section and the second section of the bottom patch to transmit a signal from the bottom patch to the top patch.

9 Claims, 8 Drawing Sheets

(A) TOP PATCH (B) BOTTOM PATCH (A) TOP PATCH (B) BOTTOM PATCH

MULTI-BAND INTERNAL ANTENNA OF SYMMETRY STRUCTURE HAVING STUB

This application is a National Stage Application of PCT Application No. PCT/KR05/02116, filed on Jul. 4, 2005.

TECHNICAL FIELD

The present invention relates to multi-band internal antenna of a symmetry structure having stub; and, more particularly, to a multi-band internal antenna of a symmetry structure having stub, in which a size of the internal antenna can be reduced by stacking loop antennas, a broadband characteristic can be obtained in a high frequency band by connecting the stub to a top patch of the antenna, and a reduced SAR and an omni-directional radiation pattern can be obtained by configuring an antenna patch in a symmetry structure.

BACKGROUND ART

In general, an antenna is installed wireless communication terminals (mobile terminal, personal communication system (PCS), personal digital assistant (PDA), IMT-2000 terminal, wireless LAN terminal, smart phone, etc.) and receives reception signals from the outside and radiates transmission signals to the outside.

That is, the antenna for receiving signals transmitted from the opposite party or transmitting signals to the opposite party is installed in an appropriate location (inside or outside) of the wireless communication terminal, and the communication with the opposite party is achieved via a wireless communication network.

As the wireless communication terminal is miniaturized and lightweight, the antenna that is one of the largest parts of the wireless communication terminal tends to be smaller, considering the receive sensitivity and harmfulness of electromagnetic wave.

A combination of helical antenna and whip antenna is most widely used as the wireless communication terminals. This antenna is an external antenna that is protruded from an outside of the wireless communication terminal. Since the external antenna requires a lot of parts at a region contacting with the antenna, its assembly process and part management are difficult. The antenna may be easily damaged due to an external impact. Also, since orientation and gain of the antenna is insufficient, high-quality of communication cannot be secured.

To solve the problems of the external antenna, a monopole antenna, a loop antenna, or a planar inverted F antenna (PIFA) is built in the wireless communication terminal, as illustrated in FIG. 1. Accordingly, an outer design of the terminal is elegant and the terminal can be miniaturized. Also, the transmission/reception characteristics can be improved. However, the monopole antenna is different to achieve frequency impedance at low frequency band. The PIFA is an internal antenna used for solving the drawbacks of the monopole antenna. However, the PIFA also has a narrow bandwidth and a current density is condensed at a specific location, resulting in high specific absorption rate (SAR).

To solve the drawbacks of the monopole antenna and the PIFA, there is proposed the loop antenna considering the impedance matching and bandwidth characteristic. However, since the loop antenna using half wavelength is very long, there is a limitation in using the loop antenna as the internal antenna of the wireless communication terminal. Also, in the case of the loop antenna, resonance bandwidth characteristic of high-order mode for multi-band is narrow. Therefore, there is a difficulty in operating the loop antenna as an actual multi-band antenna.

Meanwhile, various antennas have been proposed which can solve the size problem of the internal antenna using a stack structure. However, these antennas are limited to the monopole antenna or the PIFA and have not been applied to the loop antenna till now. Also, only the resonance length of the antenna is compensated using the stack structure.

As described above, the general internal antennas (monopoly antenna, loop antennas, and PIFAs) have limitation in size when implementing them in the built-in type. A bandwidth in a high frequency band is narrow and a current distribution in a high frequency band is differently changed in a low frequency band. Therefore, it is difficult to obtain omni-directional radiation patterns.

DISCLOSURE

Technical Problem

It is, therefore, an object of the present invention to provide a multi-band internal antenna of a symmetry structure having stub, in which a size of the internal antenna can be reduced by stacking loop antennas, and a broadband characteristic can be obtained in a high frequency band by connecting the stub to a top patch of the antenna.

Another object of the present invention is to provide a multi-band internal antenna of a symmetry structure having stub, in which a reduced SAR and an omni-directional radiation pattern can be obtained by configuring an antenna patch in a symmetry structure such that a current density is uniformly distributed in bilateral symmetry.

Technical Solution

In accordance with one aspect of the present invention, there is provided a multi-band internal antenna including: a top patch disposed in an upper portion of the antenna, the top patch being formed in a loop shape of which one end is opened; a stub connected to the top patch to expand a bandwidth of a high frequency band in an operating frequency of the antenna; a bottom patch connected to a ground part through a feeder part and a shorting part, the bottom patch being formed in a loop shape of which one end and another end are opened; a connecting part connecting the top patch to the bottom patch to transmit a signal from the bottom patch to the top patch; an intermediate part formed between the top patch and the bottom patch to a predetermined thickness; the feeder part for feeding power to the bottom patch; and the shorting part for grounding the bottom patch.

ADVANTAGEOUS EFFECTS

According to the present invention, an antenna size can be reduced by implementing a loop antenna in a stack structure.

Also, a bandwidth of a high frequency band in an operating frequency of the antenna can be greatly expanded using a stub connected to a top patch.

In addition, by configuring an antenna patch in a bilateral symmetrical structure, a current density is uniformly distributed to thereby reduce SAR. Further, it is possible to obtain omni-directional radiation pattern with respect to an entire operating frequency (low frequency band and high frequency band) of the antenna.

DESCRIPTION OF DRAWINGS

The above and other objects and features of the present invention will become apparent from the following description of the preferred embodiments given in conjunction with the accompanying drawings, in which.

BEST MODE FOR THE INVENTION

Other objects and aspects of the invention will become apparent from the following description of the embodiments with reference to the accompanying drawings, which is set forth hereinafter.

Figure 1:
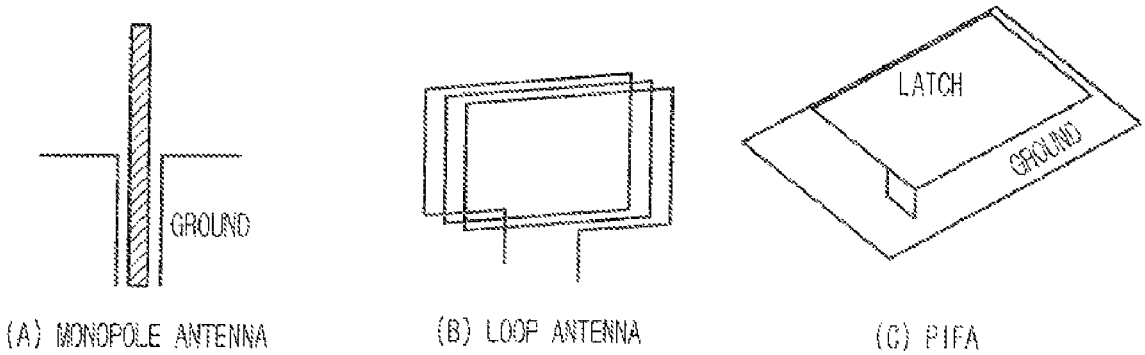
FIG. 1 (PRIOR ART)
FIG. 1 is a diagram illustrating conventional internal antennas.
Figure 2:
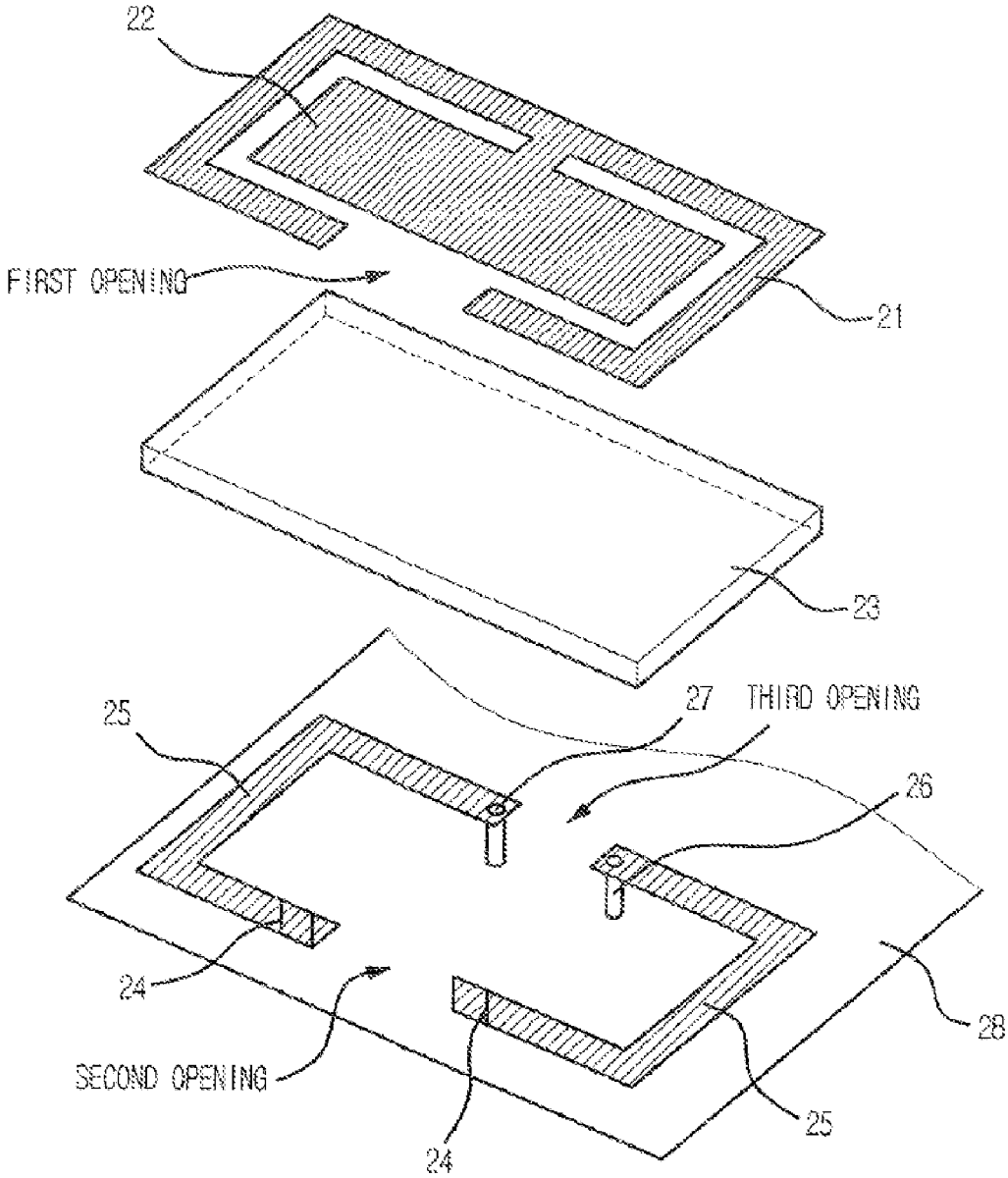
FIG. 2 is a diagram of the multi-band internal antenna of the symmetry structure having the stub in accordance with the embodiment of the present invention.

FIG. 2 is a diagram of a multi-band internal antenna of a symmetry structure having a stub in accordance with an embodiment of the present invention.

Referring to FIG. 2, the multi-band internal antenna includes a top patch 21, a stub 22, an intermediate part 23, a connecting part 24, a bottom patch 25, a feeder unit 26, a shorting part 27, and a ground part 28.

The top patch 21 is disposed an upper portion of an antenna and finally radiates signals from the bottom patch 25 to the outside. The top patch 21 is not a completely closed loop but a loop shape of which one side is opened. Hereinafter, this portion will be referred to as a first opening.

The stub 22 is connected to an opposite side of the first opening in the top patch 22.

The stub 22 expands bandwidth of a high frequency band of the antenna. That is, the stub 22 is formed inside the top patch 21 and expands bandwidth of a multi-band high frequency band by generating resonance close to a high-order mode. At this point, the stub 22 is formed in two rectangular shapes with predetermined width and length.

For understanding the present invention more fully, a general operation of the stub will be described below.

The stub is used for impedance matching in a circuit comprised of microstrip or strip line. The stub is a line that is additionally connected to a transmission line for the purpose of frequency tuning or broadband characteristic, not for the purpose of signal transmission. The stub is classified into a shunt stub vertically connected to the transmission line and a series stub horizontally connected to the transmission line.

Also, the shunt stub is classified into an open stub and a short stub. The open stub is a stub that exists in an opened shape, with its end being connected to nothing. The short stub is a stub that has a via at one end and is grounded.

When the length L is smaller than $\lambda/4$, the open stub acts as a capacitor. When the length L is greater than $\lambda/4$ and less than $\lambda/2$, the open stub acts as an inductor. An operation of the short stub is opposite to that of the open stub.

Accordingly, the stub used in the present invention is the shunt stub connected in parallel to the top patch 21 and is the open stub whose length is smaller than $\lambda/4$.

The intermediate part 23 is formed of air or dielectric material such that it has a predetermined thickness between the top patch 21 and the bottom patch 25. At this time, size (horizontal and vertical lengths) of the intermediate part 23 is equal to the top patch 21 or the bottom patch 25.

The connecting part 24 connects the top patch 21 to the bottom patch 25 and transmits signals from the bottom patch 25 to the top patch 21. At this point, when the intermediate part 23 is formed of dielectric material, not air, the connecting part 24 passes through the dielectric material and connects the top patch 21 to the bottom patch 25. Accordingly, the height of the connecting part 24 has to be equal to that of the intermediate part 23.

Also, although the connecting part 24 is provided to directly connect to both sides of the second opening of the bottom patch 25, the present invention is not limited to this configuration. That is, the connecting part 24 can be provided at any locations satisfying the antenna characteristics.

The bottom patch 25 is disposed under the intermediate part 23 and operates as one antenna together with the top patch 21. A total length of the patch given by summing the length of the top patch 21 and the length of the bottom patch 25 corresponds to a half wavelength of a low frequency band among the usable bands of the antenna.

Also, the bottom patch 25 is formed not to have a completely closed loop, but to have a second opening and a third opening, which are symmetrically formed on both sides. At this point, a connecting part 24 is formed on both sides of the second opening, and a feeder part 26 and a shorting part 27 are disposed on both sides of the third opening.

Meanwhile, the feeder part 26 feeds power to the bottom patch 25, and the shorting part 27 shorts the ground part 28 and the bottom patch 25. By implementing the feeder part 26 and the shorting part 27 such that they exist together, the bottom patch 25 itself operates as a portion of the antenna, not the feeder line.

Figure 3:
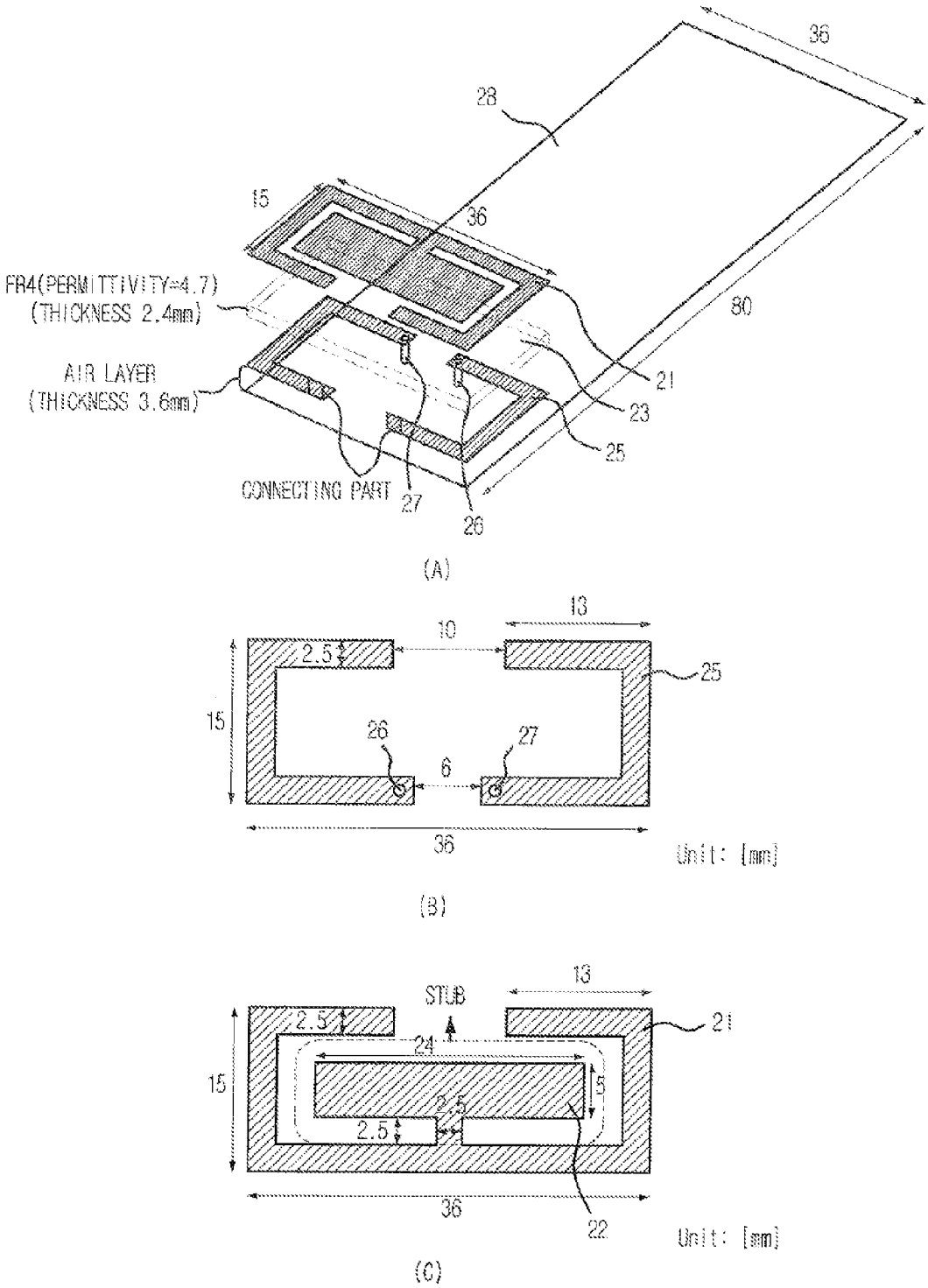
FIG. 3 is a diagram of the multi-band internal antenna of the symmetry structure having the stub in accordance with the embodiment of the present invention.

FIG. 3 is a diagram for explaining the multi-band internal antenna of the symmetry structure having the stub in accordance with the embodiment of the present invention. The respective parts of the multi-band internal antenna in accordance with the embodiment of the present invention will be described in detail with reference to FIG. 3.

The present invention is not limited to the antenna of FIG. 3. The antenna of FIG. 3 is described only for illustrative purpose for fully understanding the present invention. Accordingly, materials, structures, sizes, and locations of the antenna can be readily modified depending on operating frequencies and designs of the antenna.

Each of the top patch 21, the intermediate part 23, and the bottom patch 25 has the horizontal length of 36 mm and the vertical length of 25 mm.

A width of the top patch 21 and a width of the bottom patch 25 are 2.5 mm. In the top patch 21, a gap of the first opening is 10 mm, and each length of left and right patches symmetrical to each other on both sides of the first opening is 13 mm.

A width of the bottom patch 25 is 2.5 mm, which is equal to the width of the top patch 21. In the bottom patch 21, a gap of the third opening between the feeder part 26 and the shorting part 27 is 6 mm, and a gap of the second opening between two connecting parts 24 is 10 mm.

The stub 22 connected to the top patch 21 has a shape formed by combining a 24 (mm)×5 (mm) rectangle with a 2.5 (mm)×2.5 (mm) square.

The top patch 21, the bottom patch 25, and the stub 22 are all formed of copper, which is a kind of perfect electric conductor (PEC).

Meanwhile, the intermediate part 23 is formed of epoxy (FR4) having permittivity of 4.7 and thickness of 2.4 mm. The ground part 28 and the bottom patch 25 are spaced apart from each other by 3.6 mm.

The ground part 28 is a 80 (mm)×36 (mm) rectangular substrate.

As described above, the antenna specification of FIG. 3 is only an example and thus the present invention is not limited to this. It should be noted that antenna characteristics that will be described later with reference to FIGS. 4 to 8 were measured using the antenna of FIG. 3.

Figure 4:
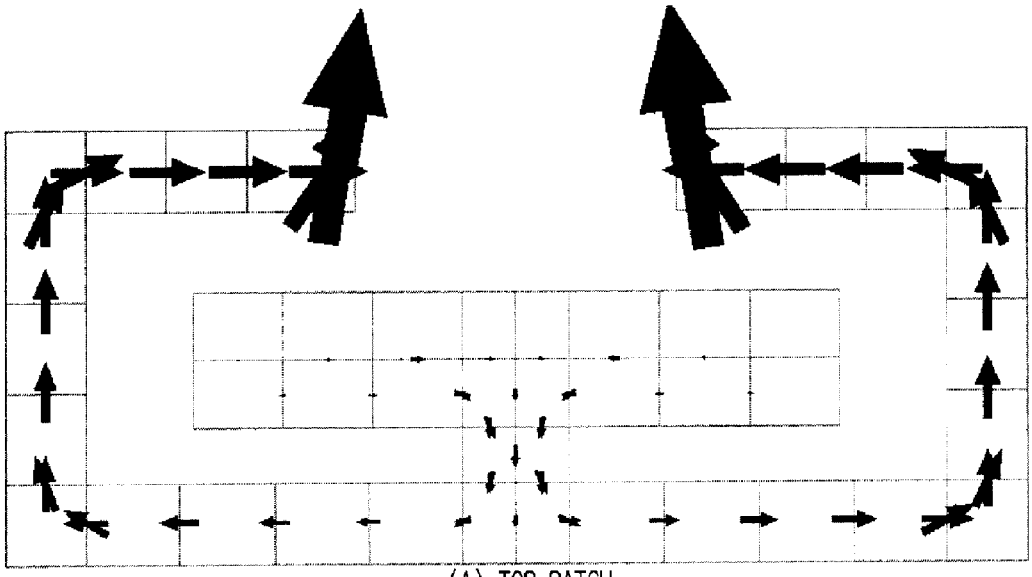
FIG. 4 is a diagram illustrating a surface current vector when the multi-band internal antenna of the symmetry structure having the stub in accordance with the embodiment of the present invention operates in a low frequency band.
Figure 4:
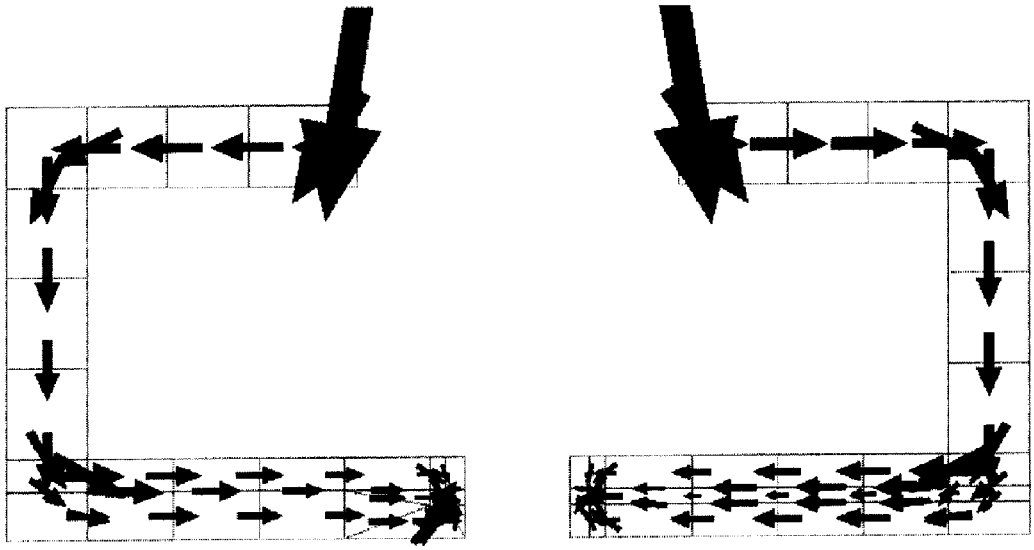

FIG. 4 is a diagram illustrating a surface current vector when the multi-band internal antenna of the symmetry structure having the stub in accordance with the embodiment of the present invention operates in a low frequency band. Specifically, FIG. 4(*a*) illustrates a current flow in the top patch 21 of the antenna, and FIG. 4(*b*) illustrates a current flow in the bottom patch 25 of the antenna.

In FIG. 4, a magnitude of an arrow represents an intensity of a current. As shown in FIG. 4, when the multi-band internal antenna operates at a low frequency, the surface current density has a bilateral distribution in both the top patch 21 and the bottom patch 25.

Figure 5:
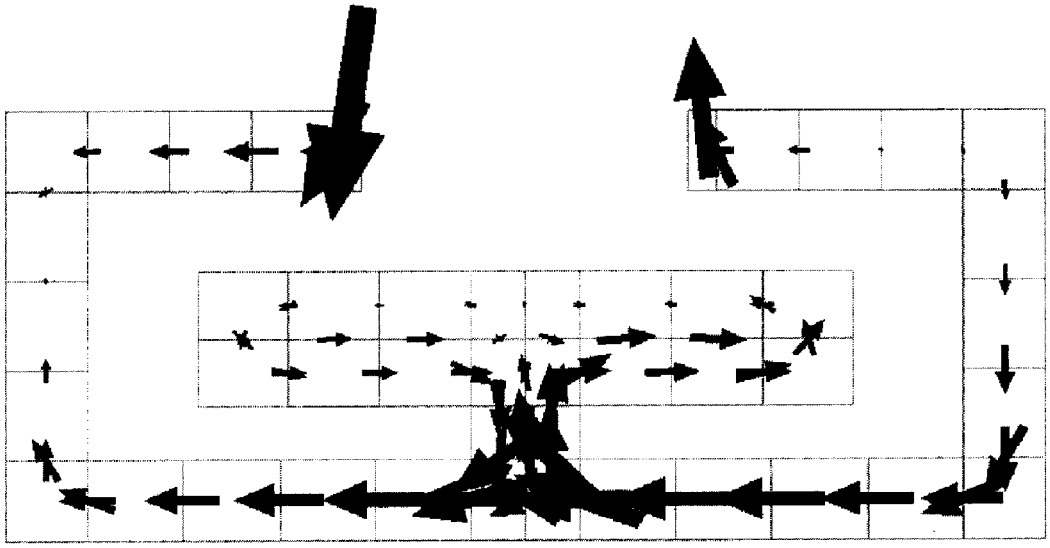
FIG. 5 is a diagram illustrating a surface current vector when the multi-band internal antenna of the symmetry structure having the stub in accordance with the embodiment of the present invention operates in a high frequency band.
Figure 5:
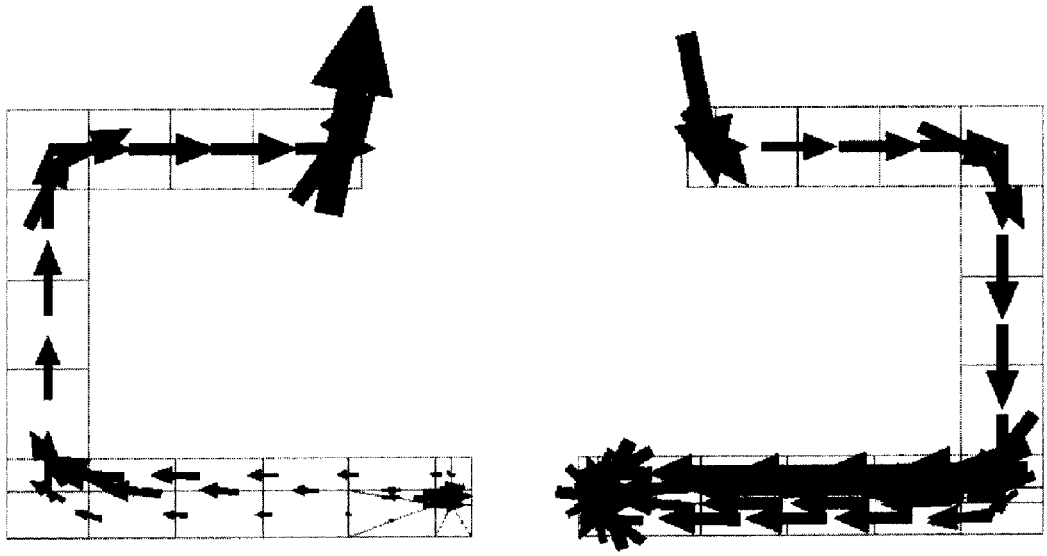

FIG. 5 is a diagram illustrating a surface current vector when the multi-band internal antenna of the symmetry structure having the stub in accordance with the embodiment of the present invention operates in a high frequency band. Specifically, FIG. 5(*a*) illustrates a current flow in the top patch 21 of the antenna, and FIG. 5(*b*) illustrates a current flow in the bottom patch 25.

In FIG. 5, a magnitude of an arrow represents an intensity of a current, like in FIG. 4. As shown in FIG. 5, when the multi-band internal antenna operates at a high frequency, the surface current density has a bilateral distribution in both the top patch 21 and the bottom patch 25, like in FIG. 4.

The surface current density of the antenna directly influences the radiation pattern. The bilaterally uniform current distribution can reduce SAR. Therefore, the antenna in accordance with the present invention can obtain omni-directional radiation pattern, which is difficult to obtain in the high frequency band. In addition, the SAR can be reduced.

Figure 6:
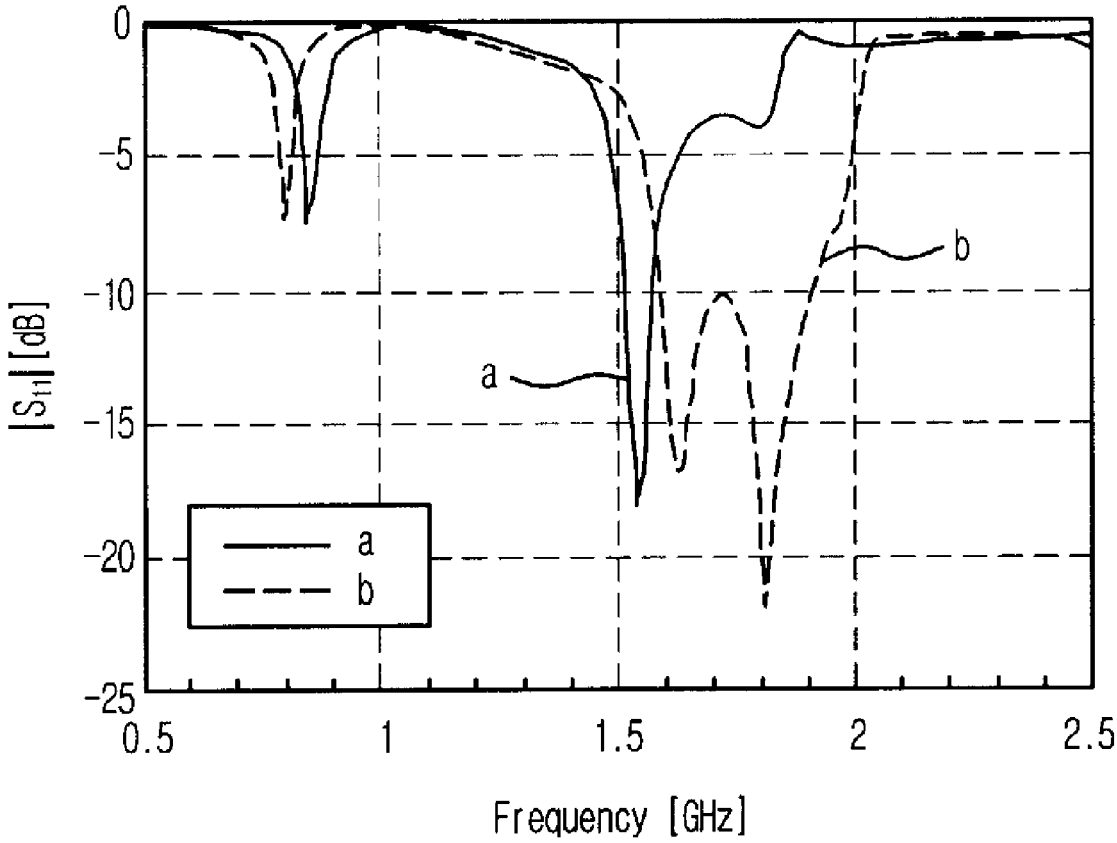
FIG. 6 is a diagram for explaining an antenna reflectivity characteristic when the stub is included and not included in the multi-band internal antenna of the symmetry structure having the stub in accordance with the embodiment of the present invention.

FIG. 6 is a diagram for explaining an antenna reflectivity characteristic when the stub is included and not included in the multi-band internal antenna of the symmetry structure having the stub in accordance with the embodiment of the present invention.

In FIG. 6, a graph "a" represents an antenna reflectivity when the stub is not included, and a graph "b" represents an antenna reflectivity when the stub is not included.

Referring to the graph "a", when the stub is not included, the bandwidth was 50 MHz in a low frequency band (center frequency: 860 MHz) and 210 MHz in a high frequency band (center frequency: 2550 MHz) with respect to the reflectivity with the resonance frequency of −6 dB or less (standing wave ratio (SWR) is 3 or less).

Referring to the graph "b", when the stub is included, the bandwidth is 40 MHz in a low frequency band (center frequency: 800 MHz) and 430 MHz in a high frequency band (center frequency: 2800 MHz) under the same condition (the reflectivity with the resonance frequency of −6 dB or less (SWR is 3 or less)).

Since the antenna includes the stub, the bandwidth in the high frequency band is greatly expanded to 210-430 MHz.

Figure 7:
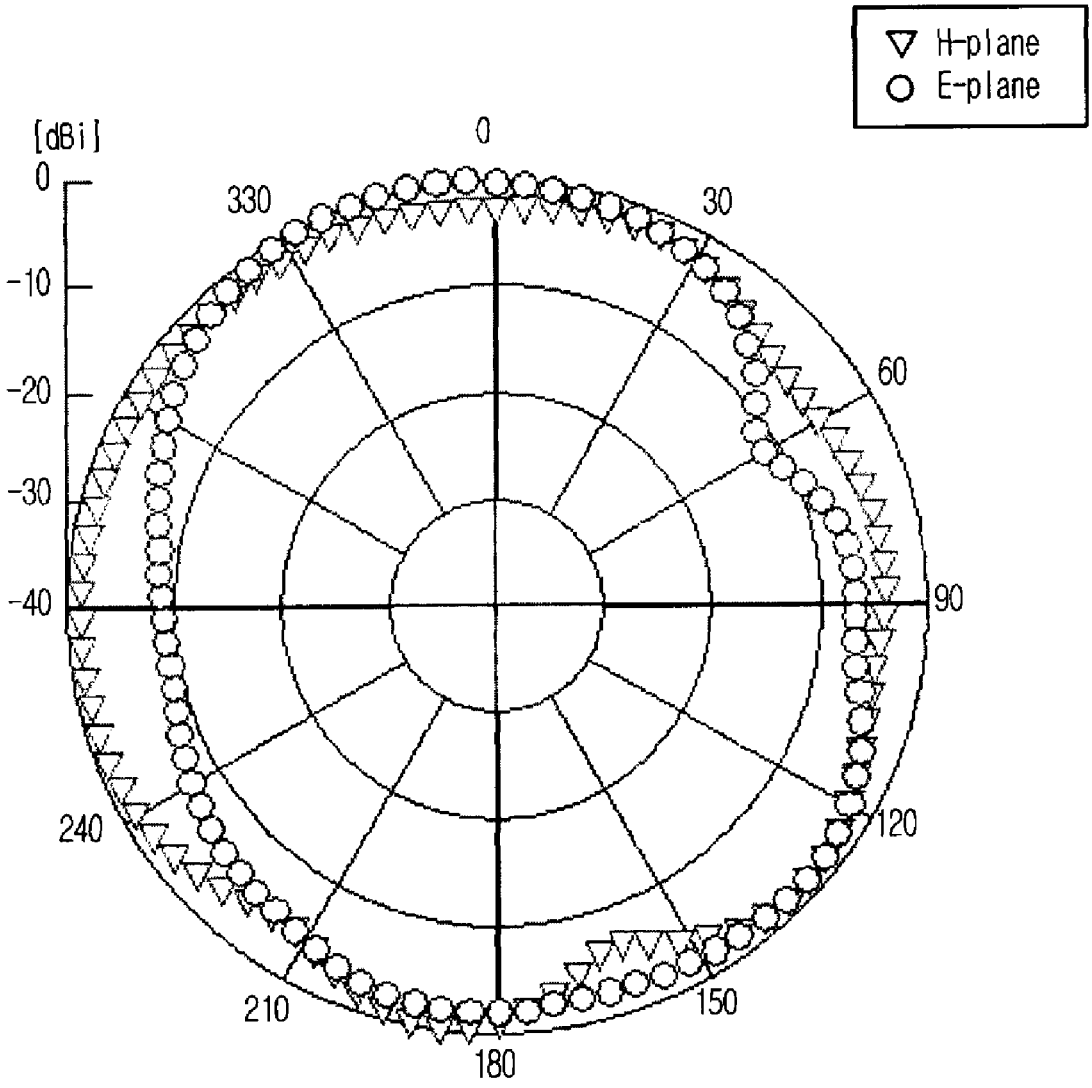
FIG. 7 is a diagram of a radiation pattern when the multi-band antenna of the symmetry structure having the stub in accordance with the embodiment of the present invention operates in a low frequency.
Figure 8:
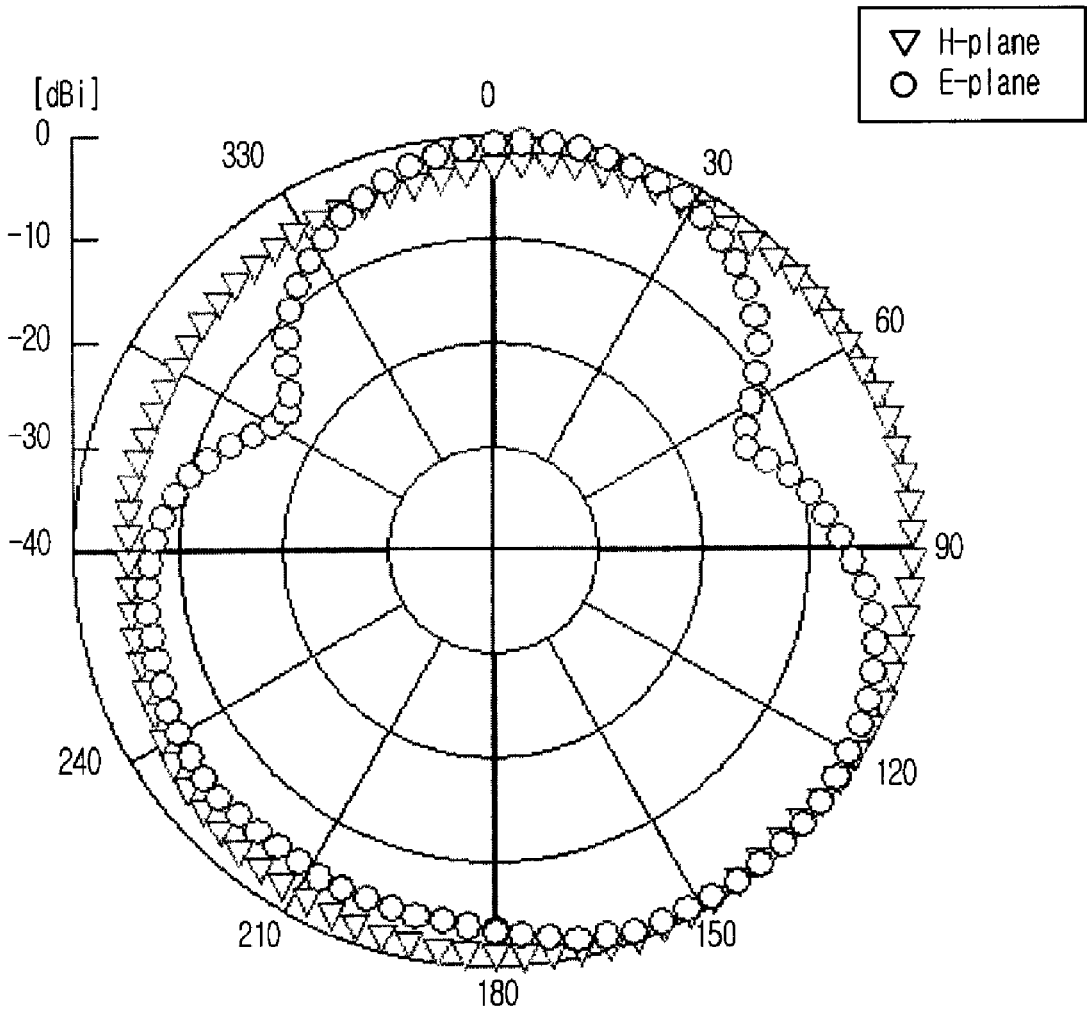
FIG. 8 is a diagram of a radiation pattern when the multi-band antenna of the symmetry structure having the stub in accordance with the embodiment of the present invention operates in a high frequency.

FIG. 7 is a diagram of a radiation pattern when the multi-band antenna in accordance with the embodiment of the present invention operates in the low frequency, and FIG. 8 is a diagram of a radiation pattern when the multi-band antenna in accordance with the embodiment of the present invention operates in the high frequency.

Referring to FIGS. 7 and 8, the multi-band internal antenna of the symmetry structure having the stub in accordance with the present invention exhibits the omni-directional radiation patterns in both the low frequency band and the high frequency band. This results from the construction in which both the top patch and the bottom patch of the antenna have the symmetry structure.

While the present invention has been described with respect to certain preferred embodiments, it will be apparent to those skilled in the art that various changes and modifications may be made without departing from the scope of the invention as defined in the following claims.

What is claimed is:

1. A multi-band internal antenna comprising:

a top patch defining a first loop that defines a space therein and a first opening;

a stub provided within the space defined by the first loop, the stub being connected to the top patch by a connector, the stub being configured to expand a bandwidth of a high frequency band in an operating frequency of the antenna;

a bottom patch provided below the top patch and having a first section and a second section connected to a feeder part and a shorting part, respectively, the bottom patch defining a second loop and second and third openings, the second and third openings being provided on opposing sides of the second loop so that the first and second sections of the bottom patch are separated from each other; and a first connecting part and a second connecting part connecting a first portion and a second portion of the top patch, respectively, to the first section and the second section of the bottom patch to transmit a signal from the bottom patch to the top patch, wherein the feeder part is configured to provide power to the bottom patch, and the shorting part is configured to ground the bottom patch.

2. The multi-band internal antenna as recited in claim 1, wherein the connector and the first opening are provided on opposing sides of the first loop, wherein the top patch is bilaterally symmetrical with respect to the connector.

3. The multi-band internal antenna as recited in claim 1, wherein the first and second sections of the bottom patch are substantially symmetrical.

4. The multi-band internal antenna as recited in claim 3, wherein the top patch, the stub and the bottom patch comprise substantially the same material.

5. The multi-band internal antenna as recited in claim 3, wherein a total length of the antenna is defined by the top patch and the first and second sections of the bottom patch, the total length corresponding to a half wavelength of a low frequency band in the operating frequency of the antenna.

6. The multi-band internal antenna as recited in claim 3, wherein the top patch and the bottom patch are spaced apart vertically by a medium.

7. The multi-band internal antenna as recited in claim 3, wherein the medium is air or dielectric material.

8. The multi-band internal antenna as recited in claim 3, wherein the first opening and the second opening are vertically aligned to each other, and the connector and the third opening are vertically aligned to each other.

9. The multi-band internal antenna as recited in claim 8, wherein the feeder part and the shorting part are spaced apart by the third opening.

* * * * *